US009765570B2

(12) United States Patent
Otten

(10) Patent No.: US 9,765,570 B2
(45) Date of Patent: Sep. 19, 2017

(54) BRACE FOR STEP LADDER

(71) Applicant: OTTEN & OTTEN CONSTRUCTION LIMITED, Orton (CA)

(72) Inventor: Martinus Albert Otten, Orton (CA)

(73) Assignee: Otten & Otten Construction Limited, Orton (CA)

( * ) Notice: Subject to any disclaimer, the term of this patent is extended or adjusted under 35 U.S.C. 154(b) by 0 days.

(21) Appl. No.: 14/796,460

(22) Filed: Jul. 10, 2015

(65) Prior Publication Data

US 2016/0010391 A1 Jan. 14, 2016

Related U.S. Application Data

(60) Provisional application No. 62/024,182, filed on Jul. 14, 2014.

(30) Foreign Application Priority Data

Sep. 2, 2014 (CA) ..... 2861673

(51) Int. Cl.
*E06C 1/39* (2006.01)
*E06C 1/18* (2006.01)
*E06C 7/14* (2006.01)

(52) U.S. Cl.
CPC ..... *E06C 1/39* (2013.01); *E06C 1/18* (2013.01); *E06C 7/14* (2013.01)

(58) Field of Classification Search
CPC ..... E06C 1/18; E06C 1/39; E06C 1/20; E06C 1/38; E06C 7/423; E06C 7/42; E06C 1/393; E06C 1/00; E06C 7/00
USPC ..... 248/121, 210, 238, 240.3, 240.4; 108/137–143; 182/116, 121, 129
See application file for complete search history.

(56) References Cited

U.S. PATENT DOCUMENTS 214,377 A * 4/1879 Dyer ..... E06C 1/32 182/116
1,323,227 A * 11/1919 Kirby ..... E06C 1/20 182/172
2,146,020 A 2/1939 Lewis
(Continued)

FOREIGN PATENT DOCUMENTS

CA 1082149 A1 7/1980
GB 599282 A 3/1948
(Continued)

OTHER PUBLICATIONS

International Search Report and Written Opinion, dated Aug. 27, 2015, issued in related International Application No. PCT/CA2015/050649.

*Primary Examiner* — Muhammad Ijaz

(57) ABSTRACT

A brace for use with a step ladder has a platform that resists shear forces and two runners. The runners are one located opposed sides of the platform and configured to fit over the unfolded struts of a step ladder. In use, a brace as described above is placed with its runners fitting over, and resting on, the struts of a step ladder. The brace stabilizes the ladder, helps prevent injury to the struts if the ladder falls over and may also force distorted struts into a better alignment. Optionally, the platform may also provide one or more surfaces for supporting tools, for example by way of a sliding shelf. Optionally, a separate tool shelf may be attached at the top of a step ladder.

14 Claims, 4 Drawing Sheets

(56) References Cited

U.S. PATENT DOCUMENTS

| | | | | | |
|---|---|---|---|---|---|
| 2,166,255 | A * | 7/1939 | Ligon | E06C 1/39 | 182/126 |
| 2,433,699 | A | 12/1947 | Keen | | |
| 2,633,376 | A | 3/1953 | Foshee | | |
| 2,652,967 | A | 9/1953 | Hansen | | |
| 3,111,297 | A * | 11/1963 | Conner | E06C 7/14 | 108/147.18 |
| 4,527,763 | A | 7/1985 | Woytowich | | |
| 4,646,658 | A * | 3/1987 | Lee | A47B 96/025 | 108/137 |
| 4,874,147 | A * | 10/1989 | Ory | E06C 7/14 | 182/129 |
| 5,058,707 | A | 10/1991 | Waid | | |
| 5,342,008 | A * | 8/1994 | Kay | E06C 7/14 | 182/129 |
| 5,614,142 | A | 3/1997 | Lilly et al. | | |
| 5,711,400 | A * | 1/1998 | Tan | E04G 1/152 | 182/119 |
| 5,715,909 | A * | 2/1998 | Gagnon | E06C 1/393 | 182/104 |
| 5,722,507 | A * | 3/1998 | Kain | E06C 1/393 | 182/104 |
| 5,740,883 | A * | 4/1998 | Trank | E06C 7/14 | 182/129 |
| 5,836,557 | A | 11/1998 | Bailey et al. | | |
| 6,116,163 | A * | 9/2000 | Mitchell | A47B 57/20 | 108/152 |
| 6,116,379 | A | 9/2000 | Huss | | |
| 6,364,136 | B1 * | 4/2002 | Weshler | A47B 96/025 | 108/102 |
| 6,412,601 | B1 * | 7/2002 | Schmidt | E06C 7/14 | 182/120 |
| 6,698,548 | B1 * | 3/2004 | Verrill | E06C 1/39 | 182/129 |
| 6,799,523 | B1 * | 10/2004 | Cunha | A47F 5/0093 | 108/108 |
| 6,902,036 | B1 | 6/2005 | Holley | | |
| 7,063,187 | B1 * | 6/2006 | Lavigne | E06C 7/14 | 182/129 |
| 7,108,103 | B2 | 9/2006 | Meeker | | |
| 7,887,016 | B2 * | 2/2011 | Gunsaullus | E06C 7/14 | 108/152 |
| 8,151,685 | B2 | 4/2012 | Joynt | | |
| 8,186,481 | B2 | 5/2012 | Moss et al. | | |
| 8,397,870 | B2 | 3/2013 | Parker | | |
| 8,701,828 | B1 | 4/2014 | Matthew | | |
| 2004/0231920 | A1 | 11/2004 | Meeker | | |
| 2005/0247838 | A1 * | 11/2005 | Zodnik | E06C 7/14 | 248/238 |
| 2009/0032662 | A1 | 2/2009 | Parrott et al. | | |
| 2010/0155177 | A1 * | 6/2010 | Tydings, III | E06C 7/14 | 182/129 |
| 2010/0236866 | A1 | 9/2010 | Huang | | |
| 2013/0001014 | A1 | 1/2013 | Halloran | | |
| 2014/0054112 | A1 | 2/2014 | Astor | | |

FOREIGN PATENT DOCUMENTS

| | | | |
|---|---|---|---|
| GB | 863900 | A | 3/1961 |
| GB | 2175948 | A | 12/1986 |
| JP | 2013-119745 | A | 6/2013 |

* cited by examiner

BRACE FOR STEP LADDER

CROSS-REFERENCES TO RELATED APPLICATIONS

This application claims the benefit of priority from U.S. Provisional Application No. 62/024,182 filed on Jul. 14, 2014 and Canadian Patent Application No. 2,861,673 filed on Sep. 2, 2014. U.S. Provisional Application No. 62/024,182 and Canadian Patent Application No. 2,861,673 are incorporated by reference.

FIELD

This specification relates to step ladders and to accessories for step ladders.

BACKGROUND

U.S. Pat. No. 5,715,909, Stepladder Including a Bracing Shelf, describes a stepladder with a pivoting bracing shelf. The bracing shelf acts as a conventional pivoting shelf and a bracing mechanism to prevent accidental closing of the stepladder when the shelf is in the bracing position.

U.S. Pat. No. 6,116,379, Ladder Stabilizing Cross Brace, describes two types of ladder stabilizing system. In one type of system, the ladder has a shelf or triangulated structure that is hinged to one side of the ladder and can be connected to the other side of the ladder. In the second type of system, there is a folding cross brace with a folding compound hinge that extends, when unfolded, diagonally across the ladder.

INTRODUCTION

The following introduction is intended to introduce the reader to the detailed description to follow and not to limit or define any claimed invention.

A typical step ladder has two sections hinged together near their upper ends. Each section has two legs. When the ladder is opened, two struts unfold to provide a horizontal linkage that prevents the ladder from opening beyond a selected angle. When the ladder is opened, the top of the ladder may provide a narrow platform.

The inventor has observed that these ladders suffer from a number of deficiencies. For example, the folding struts are typically slender and so step ladders are not rigid in use, particularly in the case of large ladders. Further, the struts are easily bent. For example, it often happens during construction work that a ladder falls over sideways and its struts become distorted. Even after only one fall, the four legs of the ladder might no longer contact a flat floor at the same time.

Conventional step ladders also encourage workers to leave tools on the narrow platform at the top of the ladder. In large ladders, this platform can be above the heads of people working around the ladder. When the ladder is bumped, or moved by another person who cannot see that there are tools on the platform, a tool can fall and break the tool or injure a person.

This specification describes a brace for use with a step ladder. The brace has a platform that resists shear forces in the plane of the platform. The brace also has two runners, one located on each of two opposed sides of the platform. The runners are configured to fit over the unfolded struts of a step ladder. Optionally, the platform may have a movable shelf, for example a sliding shelf.

In a method of bracing a step ladder, a brace as described above is placed with its runners fitting over, and resting on, the struts of the ladder. The brace stabilizes the ladder and helps prevent injury to the struts if the ladder falls over. Optionally, the runners may also force distorted struts into a better alignment. Optionally, the platform may also provide one or more surfaces for supporting tools.

This specification also describes a tool shelf for use at the top of a step ladder.

DETAILED DESCRIPTION

Figure 1:
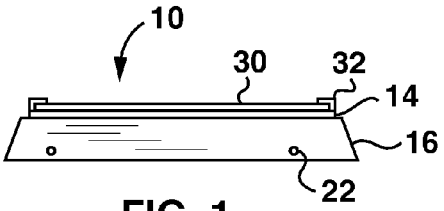
FIG. 1 shows a side view of a brace.

FIGS. 1, 2, 4, 5, 6, 7 and 8 show a brace 10 for stabilizing a step ladder 12. The brace 10 has a platform 14 and two runners 16. The brace 10 is not permanently attached to the ladder 12. To use the brace 10, the ladder 12 is opened and the brace 10 is placed over the struts 18, alternatively called straps or arms, which prevent the two sections of the ladder 12 from spreading apart. The struts 18 slide into slots 20 in the runners 16. In most cases, the struts 18 cannot be bent into an inverted V shape and lowering the brace 10 causes the struts 18 to slide into slots 20. In other cases, the struts 18 can be pushed into the slots 20 or the two sections of the ladder 12 can be pulled apart while lowering the brace 10 over the struts 18.

The slot 20 provides an interference fit over each strut 18. However, a tight fit is not required. For example, the slots 20 may be about 1 to 5 mm wider than the struts 18. A central section of the slots 20 may be widened further to make room for any pins, abutments or other elements at the joint between two struts 18. The slots 20 are preferably at least 10 mm deeper than the struts 18.

Figure 5:
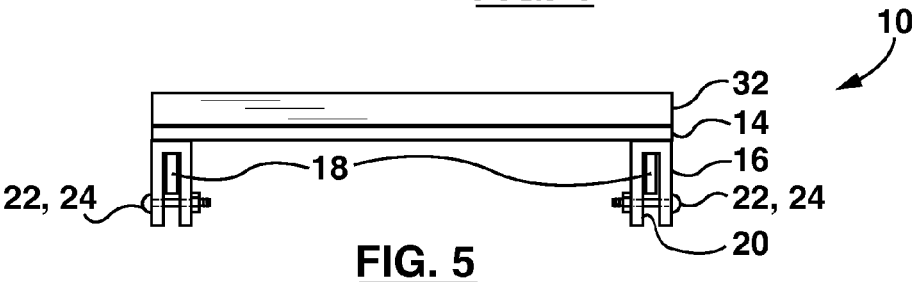
FIG. 5 shows an end view of the brace of FIG. 1.
Figure 6:
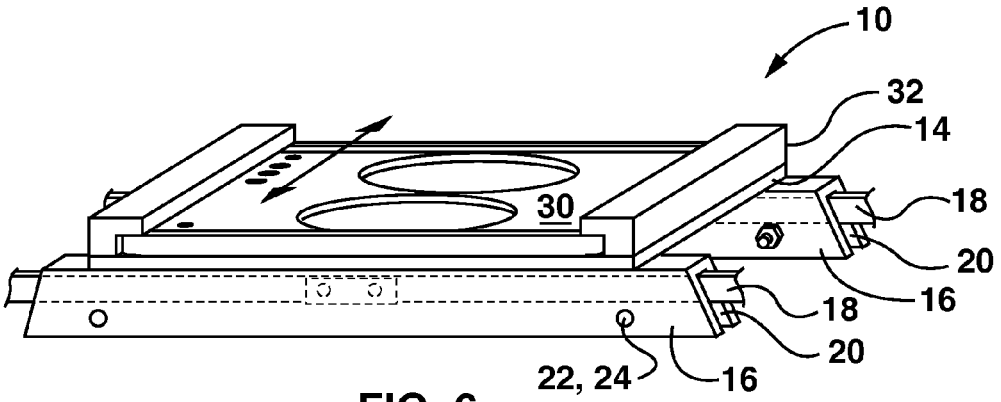
FIG. 6 shows a close up isometric view of part of the brace of FIG. 1 installed on the struts of a ladder.

Optionally, the brace 10 may have one or more fasteners or latches 22 to retain the struts 18 within the slots 20. For example, as shown in FIGS. 5 and 6, pins or bolts 24 may be placed across the width of the slot 20 below the struts 18. In many cases, these fasteners 22 are not required. However, very tall step ladders in particular are safer when the fasteners 22 are used.

The platform 14 may be continuous or discontinuous. When a discontinuous platform 14 is used, the platform 14 preferably has a lattice-like structure so that the platform 14 can still be used to hold tools or other items. However, an open truss-like structure may also be used. The platform 14 should resist shearing in the plane of the platform 14. The platform 14 should tend to keep the runners 16 parallel to each other and spaced apart from each other.

The runners 16 may also be continuous or discontinuous. If a runner 16 is discontinuous, it preferably has at least one section around a pivot between the struts 18 and two distal sections away from this pivot point. The length of the runners 16 is preferably at least 80 percent of the length of the unfolded struts 18.

The brace 10 shown in FIGS. 1, 2, 4 and 6 has an optional shelf 30. The shelf 30 is preferably movable relative to the platform 14 so that the shelf 30 can be retracted to make the brace 10 more compact at times. For example, the shelf 30 may fold or slide relative to the platform 14. The shelf 30 shown sits on top of the platform 14 and has two opposed edges held within a pair of track runners 32. This shelf 30 can slide to the left or right to extend from either side of the platform 14. Bolt holes 34 in the corners of the sliding shelf correspond with two holes 36 on the centreline of the platform in either extended position. A fastener or pin can be placed through these holes 34, 36 to retain the shelf 30 in either extended position.

While the platform 14 can be used to hold tools or a can of paint etc. directly, the shelf 30 increases the useful area of the platform 14. Since the brace 10 is low relative to the total height of the ladder 12, it provides a more stable location than a shelf near the top of a ladder for tools and other items. The stable location allows large items, for example ceiling fixtures, to be safely placed on the brace. Items on the brace 10 are also more visible to others than when a shelf is provided at the top of a ladder. Even with a relatively large ladder 12, a person can reach up to the brace 10 to place items for use when on the ladder 12. However, the brace 10 still allows a person to retrieve items temporarily placed on the brace 10 without stepping completely on or off of the ladder 12, which can be dangerous and time consuming.

For example, when installing fixtures such as a fan or light on a tall ceiling, a step ladder 12 that is more than eight feet tall may be required. It is dangerous to place a fixture on the top of such a ladder 12 before climbing on to the ladder 12. It is also dangerous to step onto a tall ladder 12 while holding a large fixture. The inventor has found that placing the fixture on the brace 10, and then stepping on to the ladder 12, and then picking up the fixture while climbing the ladder 12 provides a safer operation. Optionally, when using very tall ladders 12, for example more than 12 feet high, a concrete block or other weight can be lifted onto the brace 10 from the ground and helps to further stabilize the ladder 12.

Optionally, the platform 14 or any shelf 30 attached to the platform 14 may have a raised lip 38 around its perimeter to resist tools from rolling or sliding off the shelf 30. The lip 38 may protrude by 5 mm or more from the upper surface of the platform 14 or shelf 30. Optional holes or slots drilled through the platform 14 or shelf 30 can be used to hold one or more powered or unpowered hand tools, the end of an extension cord, or other useful items. An optional circular indentation 40 or cut-out in the upper surface of the shelf or platform can be used to help hold a can of paint or another liquid.

Figure 7:
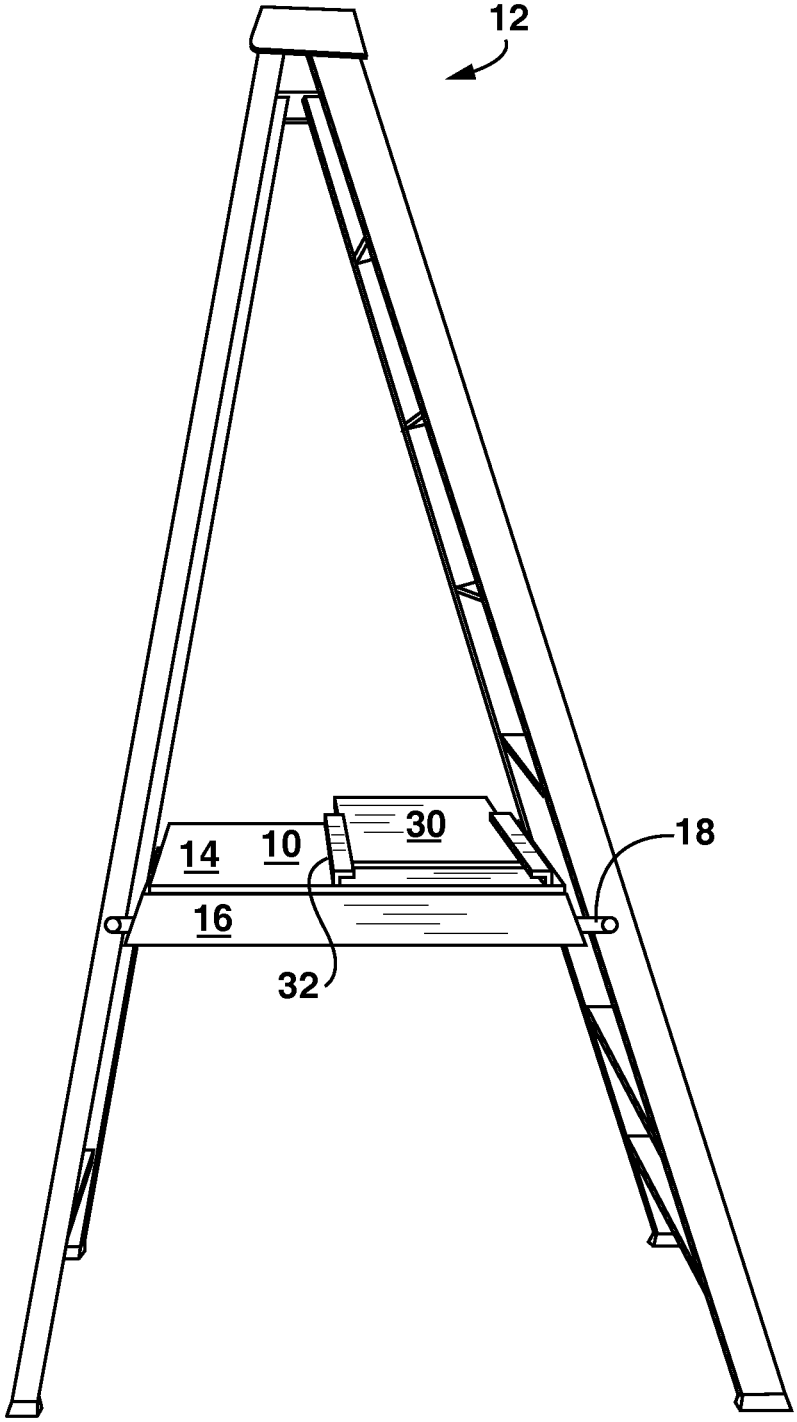
FIGS. 7 and 8 are photographs of another brace.
Figure 8:
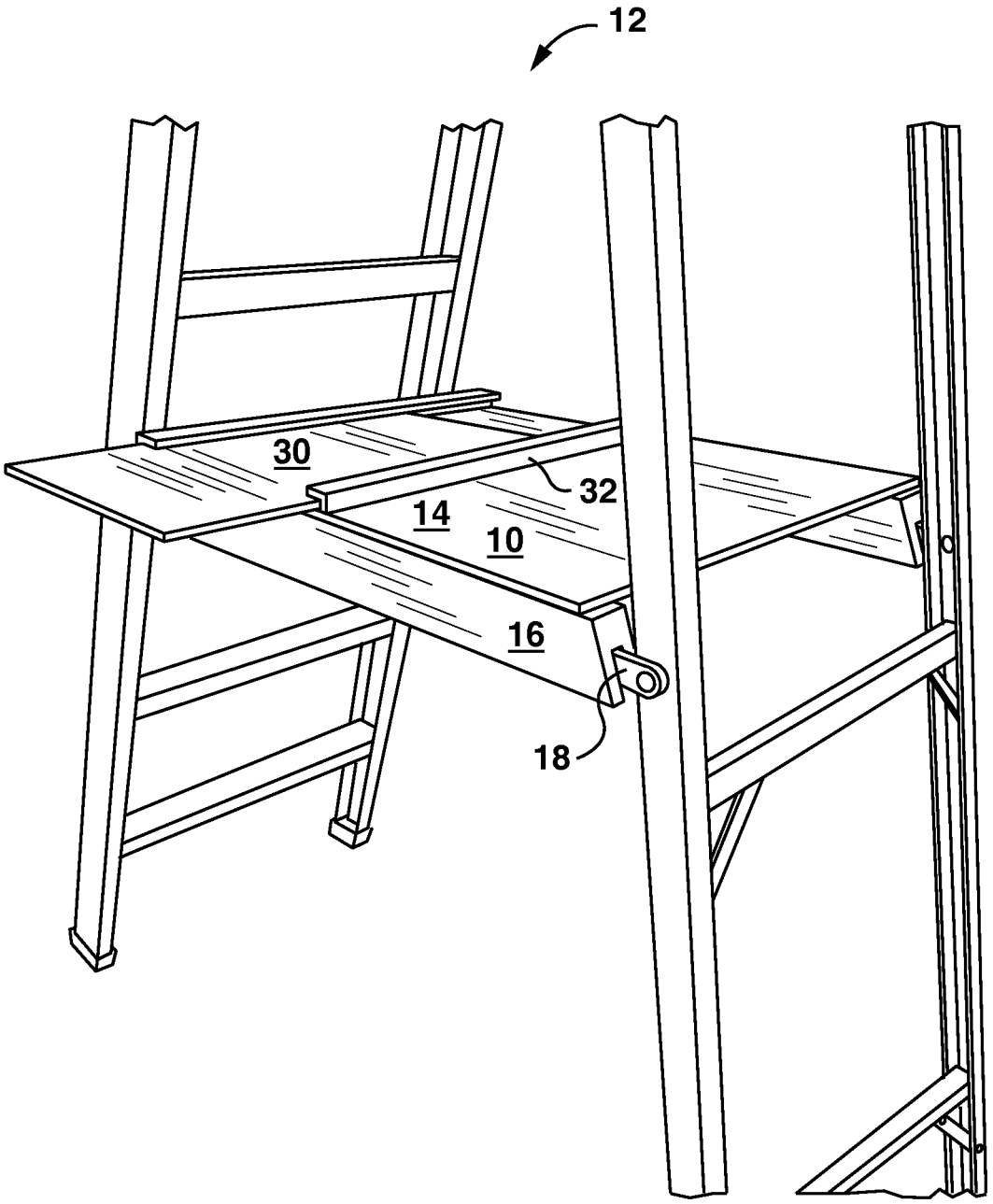

The brace 10 shown in FIGS. 7 and 8 was designed to fit one size of FEATHERLITE™ ladder 12. These ladders 12 are available at many retail outlets. The dimensions of the brace 10 can be adjusted to fit other commercially available ladders 12. The brace 10 shown was constructed of wood but other materials, such as plastic, can also be used. The brace 10 has a sliding shelf 30 but may be made without a shelf 30.

Figure 2:
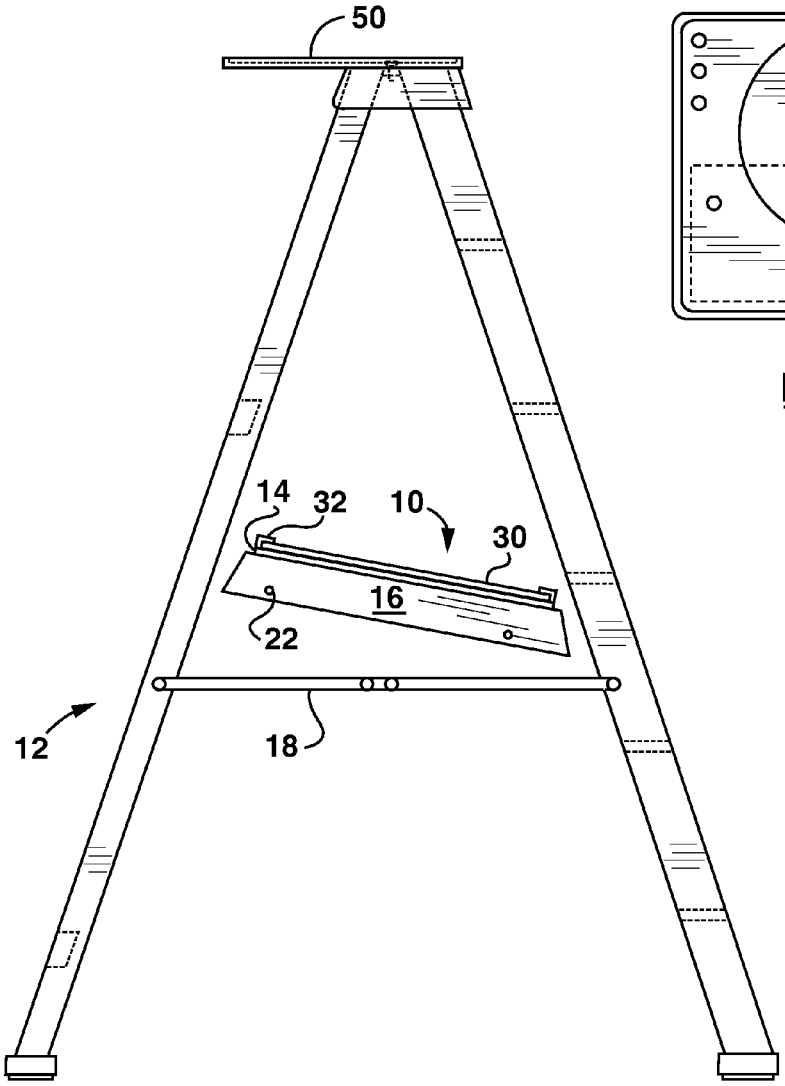
FIG. 2 shows a side view of the brace of FIG. 1 and a ladder, wherein the brace is on its way to being installed on the ladder.
Figure 3:
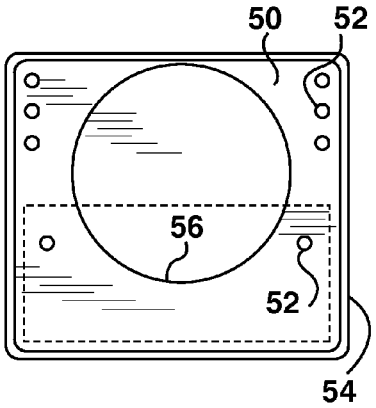
FIG. 3 shows a top view of a tool shelf for use on the top of a ladder.
Figure 4:
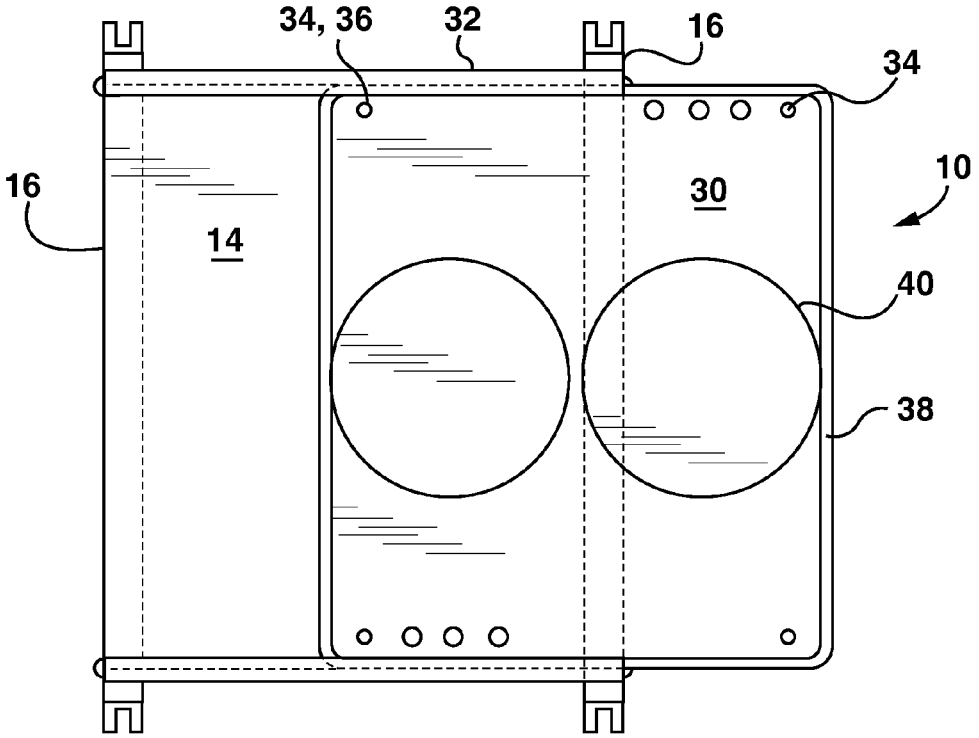
FIG. 4 shows a top view of the brace of FIG. 1 with an optional sliding shelf extended.

The top of FIG. 2 and FIG. 3 show another shelf 50. This shelf 50 can be attached to the top of a ladder 12 by fasteners placed through two or more bolt holes 52 in the shelf 50 and corresponding holes in the top of the ladder. These bolt holes 52 may be located in the shelf 50 to correspond with exiting holes in the top of a ladder 12. Alternatively, corresponding holes may be drilled into the top of the ladder 12. The fasteners may be, for example, flat head screws. The shelf 50 may be left in place or removed when not in use.

The shelf 50 of FIG. 3 is not meant for standing on but can be used to hold tools. The shelf 50 preferably has a raised lip 54 around its perimeter to resist tools from rolling or sliding off the shelf 50. The lip 54 may protrude by 5 mm or more from the upper surface of the shelf 50. Optional holes or slots drilled through the shelf can be used to hold one or more powered or unpowered hand tools, the end of an extension cord, or other useful items. An optional circular indentation 56 or cut-out in the upper surface of the shelf can be used to help hold a can of paint or another liquid. However, as discussed above, large items or items that could be bumped off of a shelf 50 are preferably kept on the brace 10 rather than at the top of a ladder 12.

I claim:

1. A brace for a step ladder having two sections with rungs hinged together at their upper ends and two struts perpendicular to the rungs each comprising a pivot and providing a linkage between the two sections, the brace comprising:

a platform having two opposed sides; and, two runners, one of the runners extending horizontally in length along one of the opposed sides of the platform and the other one of the runners extending horizontally in length along the other of the opposed sides of the platform, the runners being parallel to the platform, wherein each runner comprises a slot extending in length along the entire length of the runner and generally parallel to the platform and each slot opens downwards along its entire length in the same direction as the other slot and wherein the brace is adapted to be placed between the two sections of the ladder with the slots fitting simultaneously over the two struts of the step ladder and with the pivot of the struts disposed in the slots when the struts are unfolded and the struts and the platform are horizontal.

2. The brace of claim 1 wherein the platform is continuous.

3. The brace of claim 1 wherein each of the runners comprises one or more latches selectively locatable across the slots.

4. The brace of claim 1 wherein the brace comprises a movable shelf.

5. The brace of claim 4 wherein the moveable shelf has a raised lip.

6. The brace of claim 4 wherein the movable shelf is a sliding shelf.

7. The brace of claim 1 wherein the runners are continuous.

8. The brace of claim 1 wherein the platform is discontinuous.

9. The brace of claim 1 wherein the runners are discontinuous.

10. A method of bracing a ladder, wherein the ladder has two sections with rungs hinged together at their upper ends, and has two unfolded horizontal struts perpendicular to the rungs, each strut comprising a pivot and providing a linkage between the two sections that prevents the two sections from opening beyond a selected angle, the method comprising a step of:

placing a brace over the unfolded horizontal struts of the ladder, wherein the brace comprises a platform having two opposed sides and two runners, one of the runners extending horizontally in length along one of the opposed sides of the platform and the other one of the runners extending in length along the other of the opposed sides of the platform, and wherein each runner comprises a slot extending in length along the entire length of the runner generally parallel to the platform and each slot opens downwards along its entire length in the same direction as the other slot and wherein the slots of the runners of the brace are disposed over the unfolded horizontal struts of the ladder with the pivot of the struts disposed in the slots.

11. The method of claim 10 further comprising a step of locating one or more latches across the slots of the runners below the unfolded horizontal struts of the ladder.

12. A braced step ladder comprising a brace, the brace comprising:

a platform having two opposed sides; and, two runners, one of the runners extending horizontally in length along one of the opposed sides of the platform and the other one of the runners extending in length along the other of the opposed sides of the platform, wherein each runner comprises a slot extending in length along the length of the runner generally parallel to the platform and each slot opens downwards along its entire length in the same direction as the other slot; and, a ladder, the ladder having two sections with rungs hinged together at their upper ends, and having two unfolded horizontal struts perpendicular to the rungs, each strut comprising a pivot and providing a linkage between the two sections that prevents the two sections from opening beyond a selected angle, wherein the slots of the runners of the brace are disposed over the unfolded horizontal struts of the ladder with the pivot of the struts disposed in the slots.

13. The brace of claim 12 wherein each of the slots is at least 10 mm deeper than the unfolded horizontal struts of the ladder.

14. The brace of claim 12 wherein each of the slots is about 1 to 5 mm wider than the unfolded horizontal struts of the ladder.

* * * * *